US012698600B2

(12) United States Patent
Irion et al.

(10) Patent No.: US 12,698,600 B2
(45) Date of Patent: Aug. 4, 2026

(54) ROUTE MAINTENANCE SYSTEM AND METHOD

(71) Applicant: Nordco Inc., Oak Creek, WI (US)

(72) Inventors: Allan Irion, Milwaukee, WI (US); William D. Straub, Elm Grove, WI (US); Bruce Michael Boczkiewicz, Castine, ME (US); Justin Jerome Pipol, Hartland, WI (US); Kyle Matthew Neubauer, Lexington, SC (US); Nichalos Lee Schultz, New Berlin, WI (US); Jim Boyd, Oak Creek, WI (US)

(73) Assignee: Nordco Inc.

( * ) Notice: Subject to any disclaimer, the term of this patent is extended or adjusted under 35 U.S.C. 154(b) by 824 days.

(21) Appl. No.: 18/084,042

(22) Filed: Dec. 19, 2022

(65) Prior Publication Data

US 2023/0121770 A1 Apr. 20, 2023

Related U.S. Application Data

(63) Continuation-in-part of application No. 16/598,740, filed on Oct. 10, 2019, now abandoned.

(60) Provisional application No. 62/744,049, filed on Oct. 10, 2018.

(51) Int. Cl.
*E01B 27/11* (2006.01)
*E01B 27/16* (2006.01)

(52) U.S. Cl.
CPC ..... *E01B 27/11* (2013.01); *E01B 27/16* (2013.01)

(58) Field of Classification Search
CPC ..... E01B 27/11; E01B 27/16; E01B 29/24
See application file for complete search history.

(56) References Cited

U.S. PATENT DOCUMENTS

| | | | | |
|---|---|---|---|---|
| 4,881,467 | A * | 11/1989 | Theurer | E01B 27/17 104/7.2 |
| 5,671,679 | A * | 9/1997 | Straub | E01B 31/02 104/2 |
| 9,971,667 | B1 | 5/2018 | Jenkins et al. | |
| 10,554,518 | B1 | 2/2020 | Troy de Freitas et al. | |
| 10,591,970 | B2 | 3/2020 | Harper et al. | |
| 11,275,357 | B2 | 3/2022 | Liu et al. | |
| 2014/0337277 | A1 | 11/2014 | Asenjo et al. | |

(Continued)

FOREIGN PATENT DOCUMENTS

| | | |
|---|---|---|
| CN | 202956182 U | 5/2013 |
| CN | 203104119 U | 7/2013 |

(Continued)

*Primary Examiner* — Robert J McCarry, Jr.
(74) *Attorney, Agent, or Firm* — K&L Gates LLP

(57) ABSTRACT

A rail maintenance of way machine for a route is provided that includes a single chassis supporting a plurality of working modules. The modules include at least a broom module that can manipulate ballast and loose material that are disposed on a location of the route adjacent to the chassis a spike supply module that can provide a fastener; a tie spiker module that can receive the fastener from the spike supply module and to drive the supplied fastener through an aperture defined by a tie plate and into a replacement tie; and an anchor module that can remove an installed anchor from an installed tie and to install an anchor onto the replacement tie.

20 Claims, 19 Drawing Sheets

(56) References Cited

U.S. PATENT DOCUMENTS

| | | | |
|---|---|---|---|
| 2020/0327029 | A1 | 10/2020 | Prakash et al. |
| 2021/0171072 | A1 | 6/2021 | Hamilton et al. |

FOREIGN PATENT DOCUMENTS

| | | | |
|---|---|---|---|
| CN | 102354329 | B | 8/2013 |
| CN | 104218679 | A | 12/2014 |
| CN | 104238509 | A | 12/2014 |
| CN | 103107601 | B | 2/2015 |
| CN | 106936860 | A | 7/2017 |
| CN | 107273273 | A | 10/2017 |
| CN | 109507986 | A | 3/2019 |
| CN | 110515932 | A | 11/2019 |
| CN | 109507924 | B | 6/2021 |
| CN | 113112086 | A | 7/2021 |
| CN | 109325601 | B | 5/2022 |
| IN | 110728443 | A | 1/2020 |
| JP | 6612704 | B2 | 11/2019 |
| WO | 2015138706 | A1 | 9/2015 |
| WO | 2020133250 | A1 | 7/2020 |
| WO | 2021121182 | A1 | 6/2021 |

* cited by examiner

ROUTE MAINTENANCE SYSTEM AND METHOD

CROSS-REFERENCE TO RELATED APPLICATIONS

This application is a Continuation-in-Part of U.S. application Ser. No. 16/598,740, filed on Oct. 10, 2019, which claims priority to U.S. Provisional Application Ser. No. 62/744,049, filed Oct. 10, 2018, the contents of which are incorporated by reference.

BACKGROUND

Technical Field

Embodiments of the invention relate to railway maintenance equipment.

Discussion of Art

In some railway maintenance operations, groups or gangs of maintenance equipment perform designated sequences of rail maintenance activities. These activities may include spike pulling, anchor spreading, rail lifting, tie plate removal, tie extraction, tie insertion, tie plate insertion, rail lowering, spike driving, anchor squeezing, ballast regulating, and/or track leveling. These tasks may each performed by designated, task-specific, self-propelled railway maintenance machines, each having at least one operator on board for performing the designated maintenance operation, as well as controlling the movement of the machine along the track, and in coordination with other machines in the gang. The machines are positioned along the track in the order of the needed performance of the designated maintenance task.

The conventional practice uses many machines in the gang, and as such a designated inventory of parts may be needed for each task-specific machine. Further, each conventional machine in the gang may have a designated operator, trained for performing a repetitive task. It may be desirable to have a railway maintenance system that differs from those that are currently available.

BRIEF DESCRIPTION

In one embodiment, a rail maintenance of way machine for a route is provided that includes a single chassis supporting a plurality of working modules. The modules include at least a broom module that can manipulate ballast and loose material that are disposed on a location of the route adjacent to the chassis; a spike supply module that can provide a fastener; a tie spiker module that can receive the fastener from the spike supply module and to drive the supplied fastener through an aperture defined by a tie plate and into a replacement tie; and an anchor module that can remove an installed anchor from an installed tie and to install an anchor onto the replacement tie.

The plurality of working modules may further include one or more of the optional modules selected from a spike puller module configured to remove an installed fastener from the installed tie; a spike reclaimer module configured to retrieve the removed fastener and to supply the removed fastener to the spike supply module; a tie plate reclaimer module configured to selectively retrieve a tie plate and to install a tie plate onto the replacement tie; a tie bed scarifier module configured to widen a channel left in the ballast as a result of the removal of the installed tie; a tie replacement module configured to retrieve the installed tie from ballast and to place a replacement tie into the ballast at determined intervals and orientations; and a tie tamper module configured to tamp and level a replacement tie.

A method relating to activities performed on a route is provided in one embodiment. The method includes controlling plural working modules that are arranged on a single chassis to each perform at least one action. The actions may include manipulating ballast and loose material that are disposed on a location of the route adjacent to the chassis; removing an installed anchor from an installed tie and to install an anchor onto the replacement tie providing a fastener to a spiker module; and receiving the fastener and driving the supplied fastener through an aperture defined by a tie plate and into a replacement tie.

DETAILED DESCRIPTION

Figure 1:
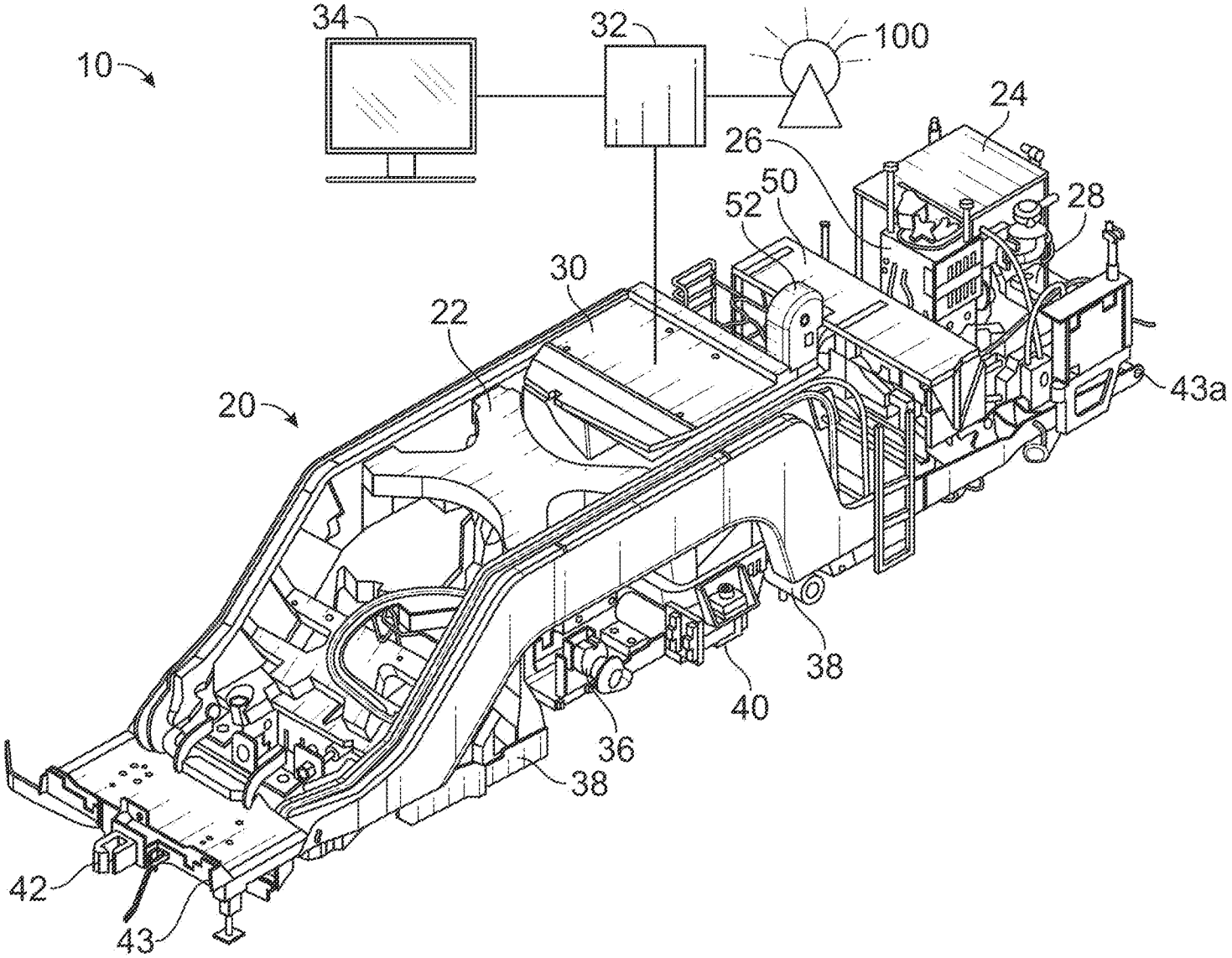
FIG. 1 is a top front perspective view of a puller module of a multi-module rail maintenance system according to an embodiment of the invention.
Figure 2:
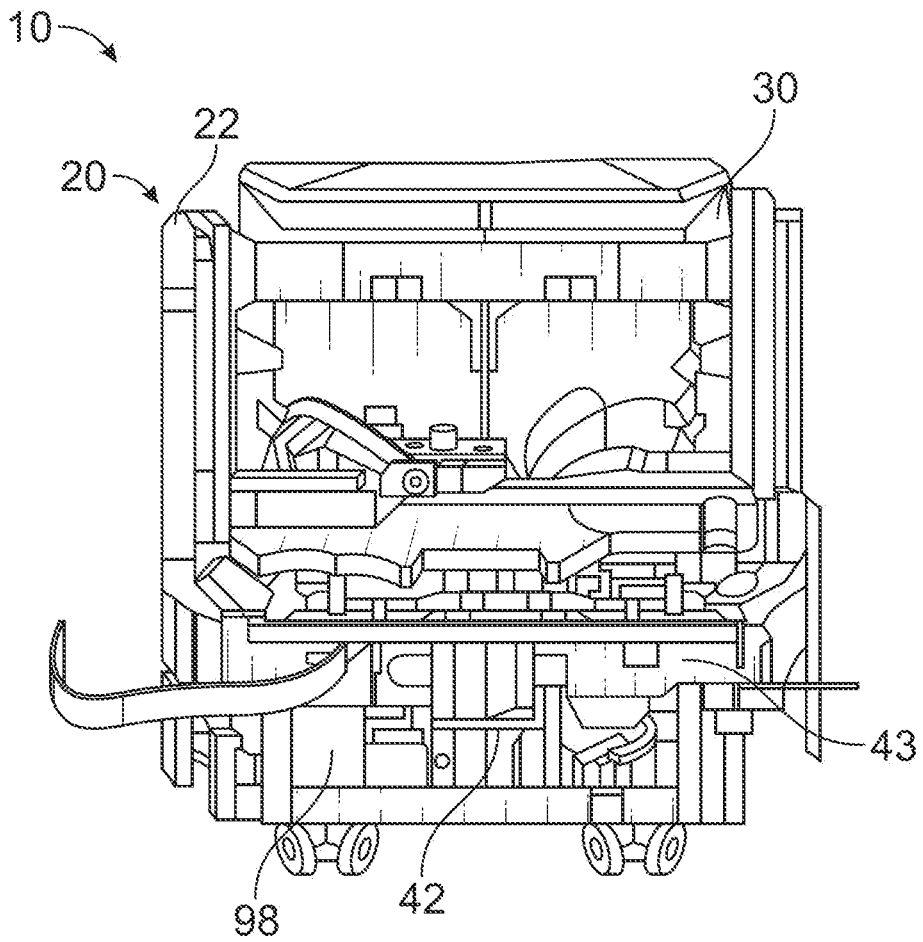
FIG. 2 is a rear view of the puller module of FIG. 1.
Figure 3:
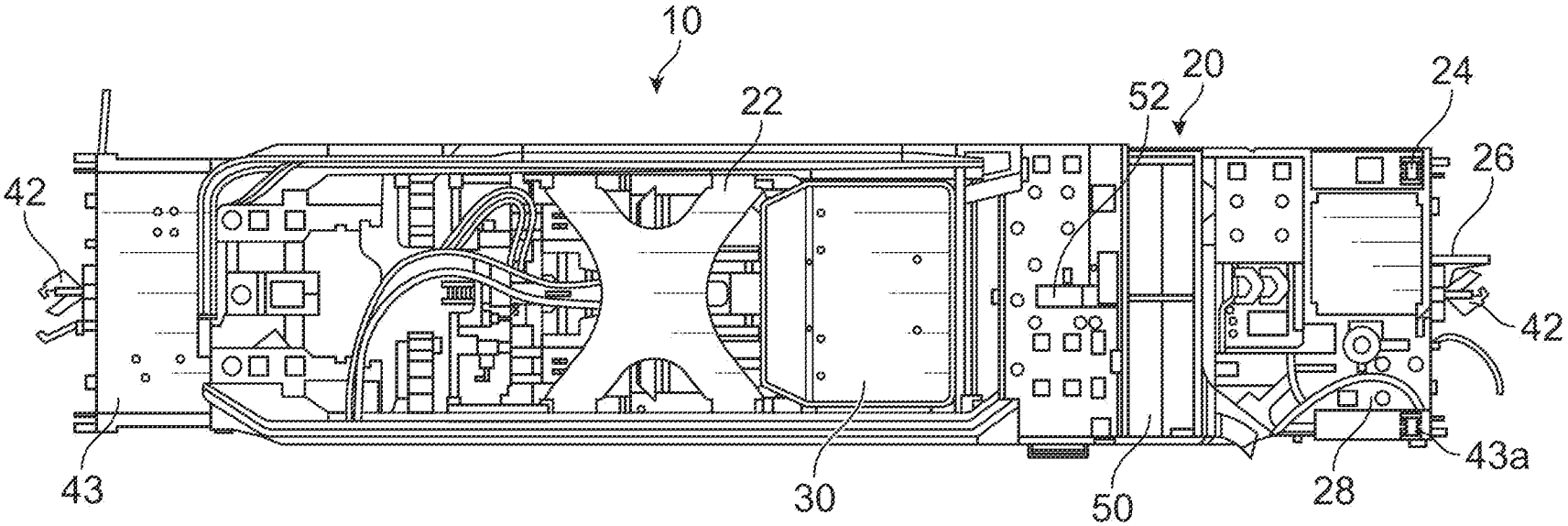
FIG. 3 is a top view of the puller module of FIG. 1.
Figure 4:
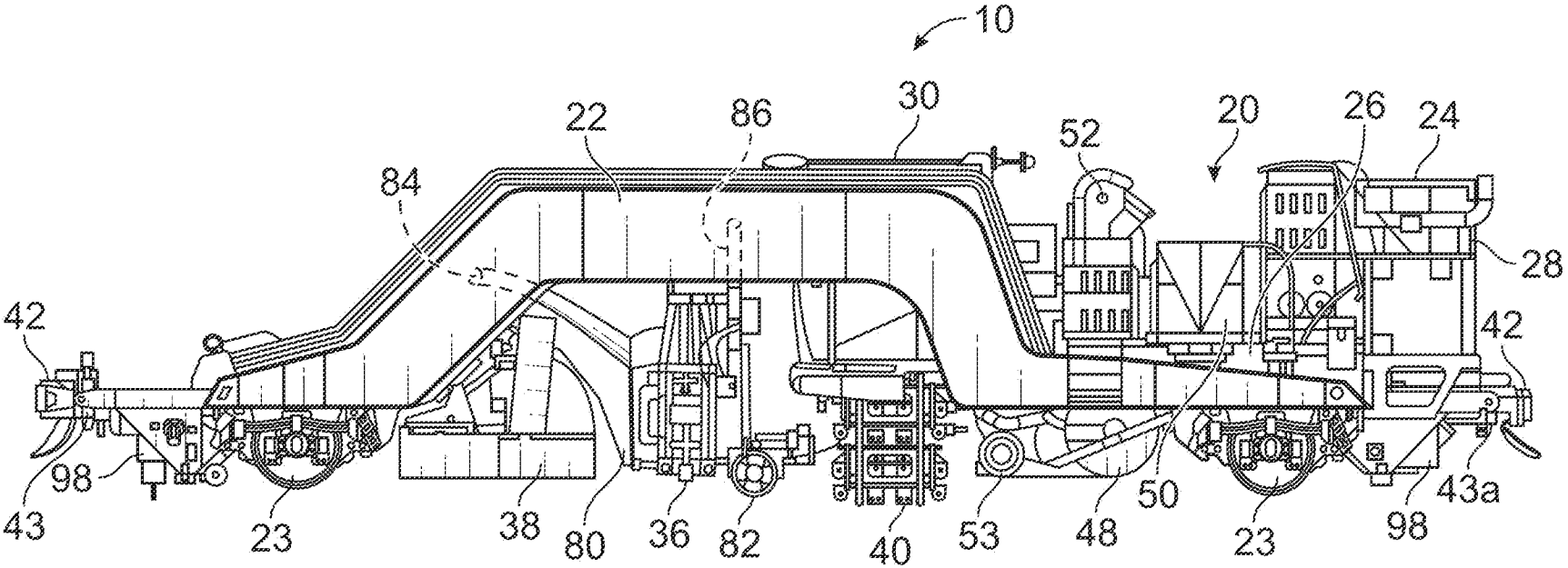
FIG. 4 is a side view of the puller module of FIG. 1.
Figure 5:
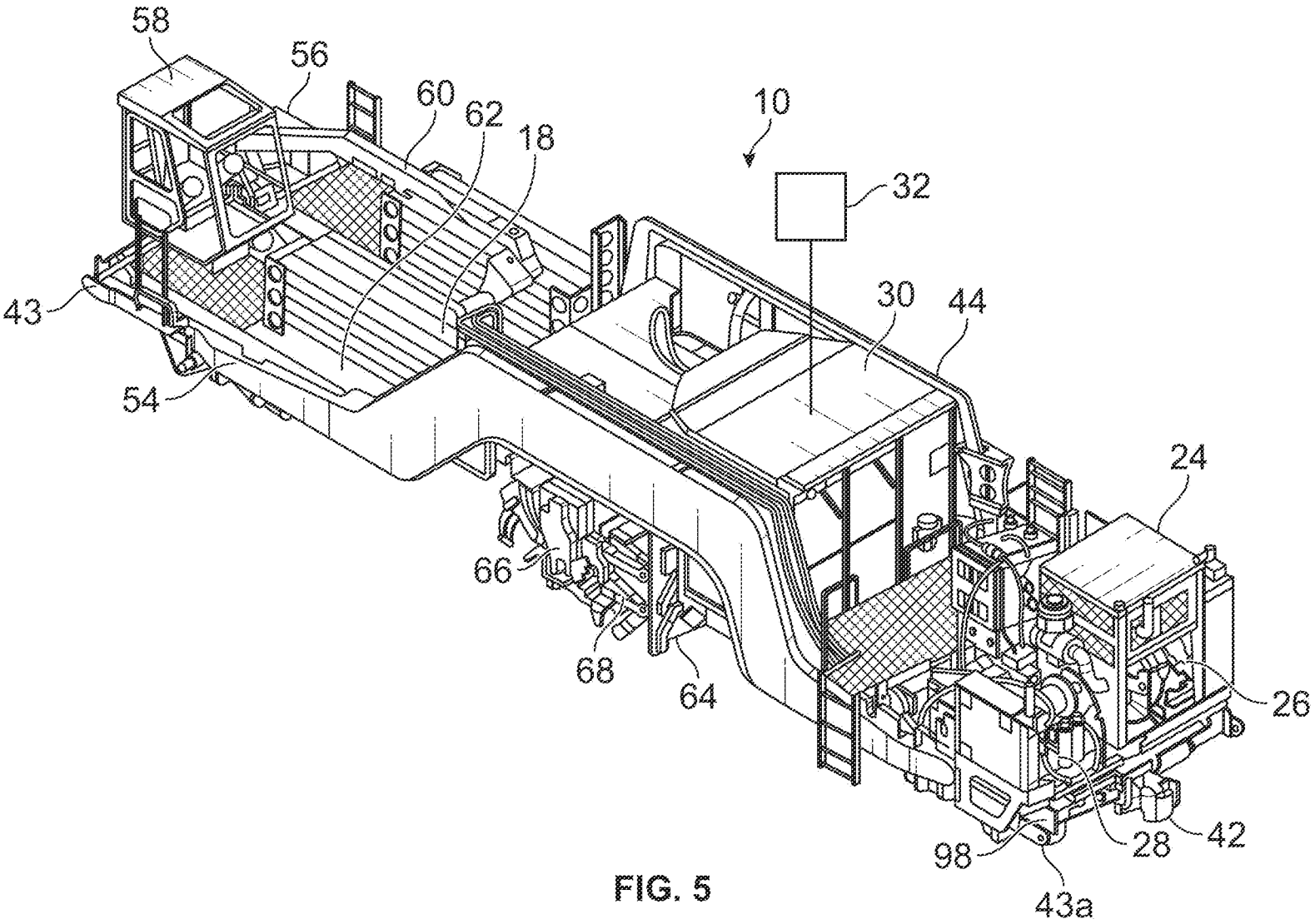
FIG. 5 is a top perspective view of a second, exchanger module of a multi-module rail maintenance system showing features of embodiments of the invention.
Figure 6:
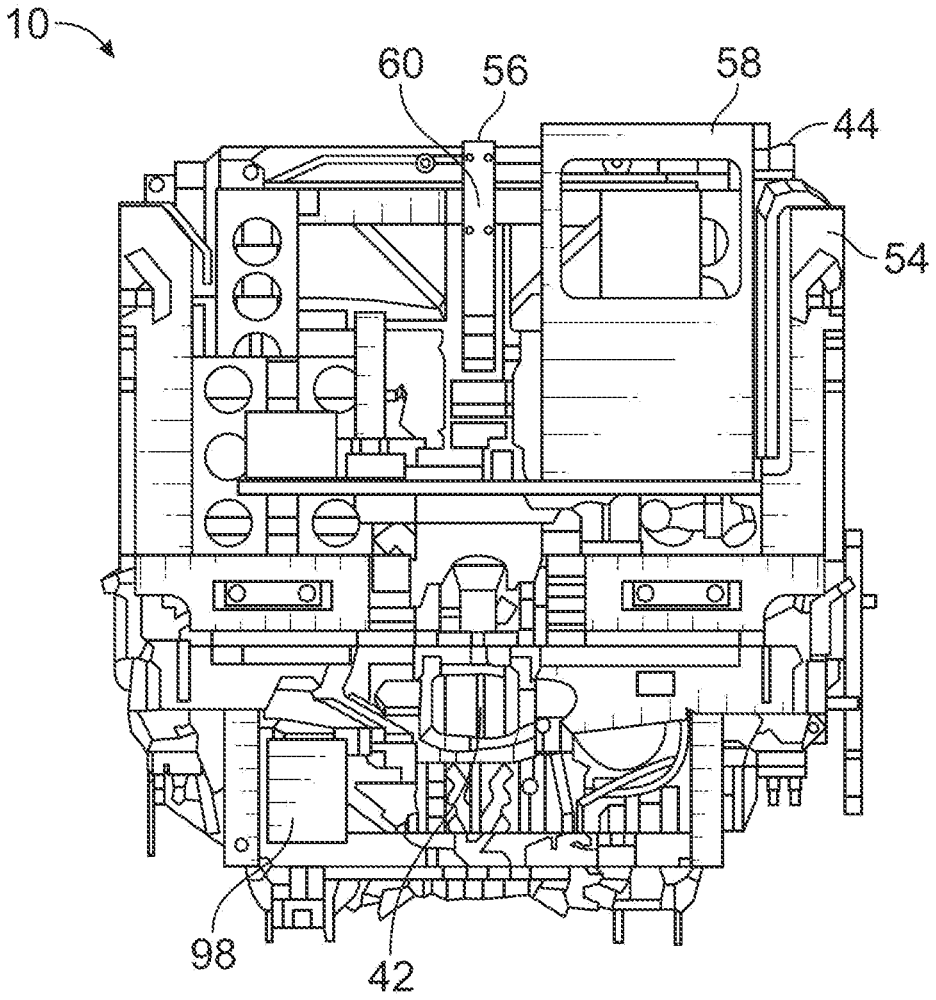
FIG. 6 is a front view of the exchanger module of FIG. 5.
Figure 7:
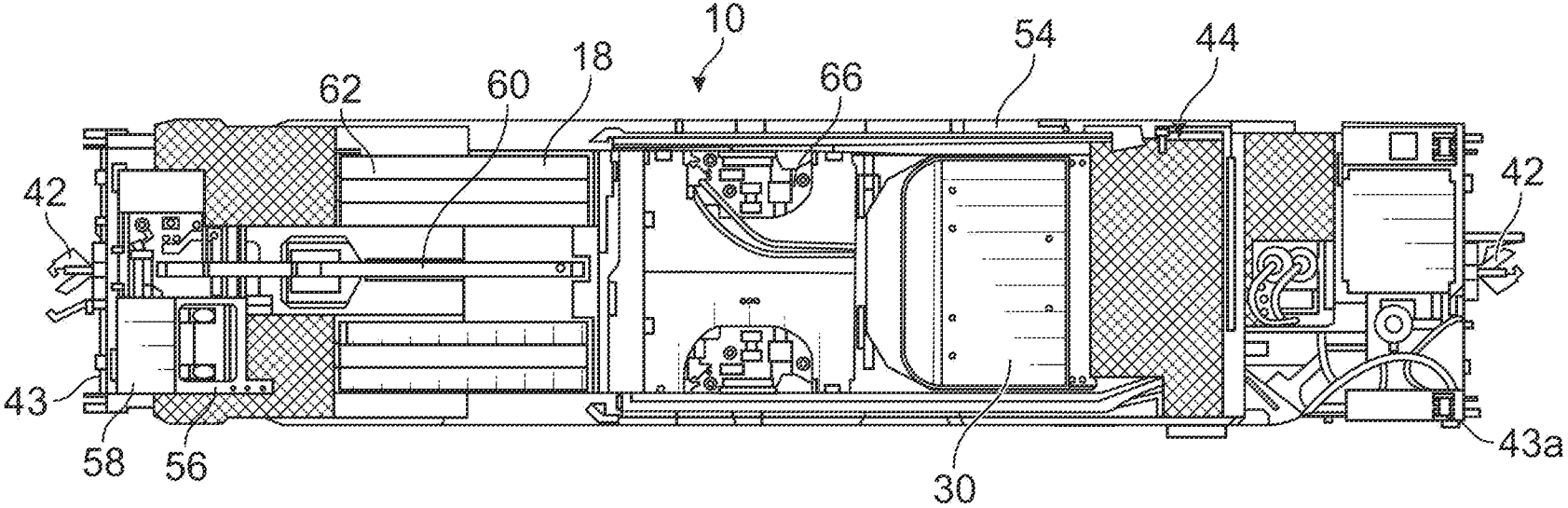
FIG. 7 is a top view of the exchanger module of FIG. 5.
Figure 8:
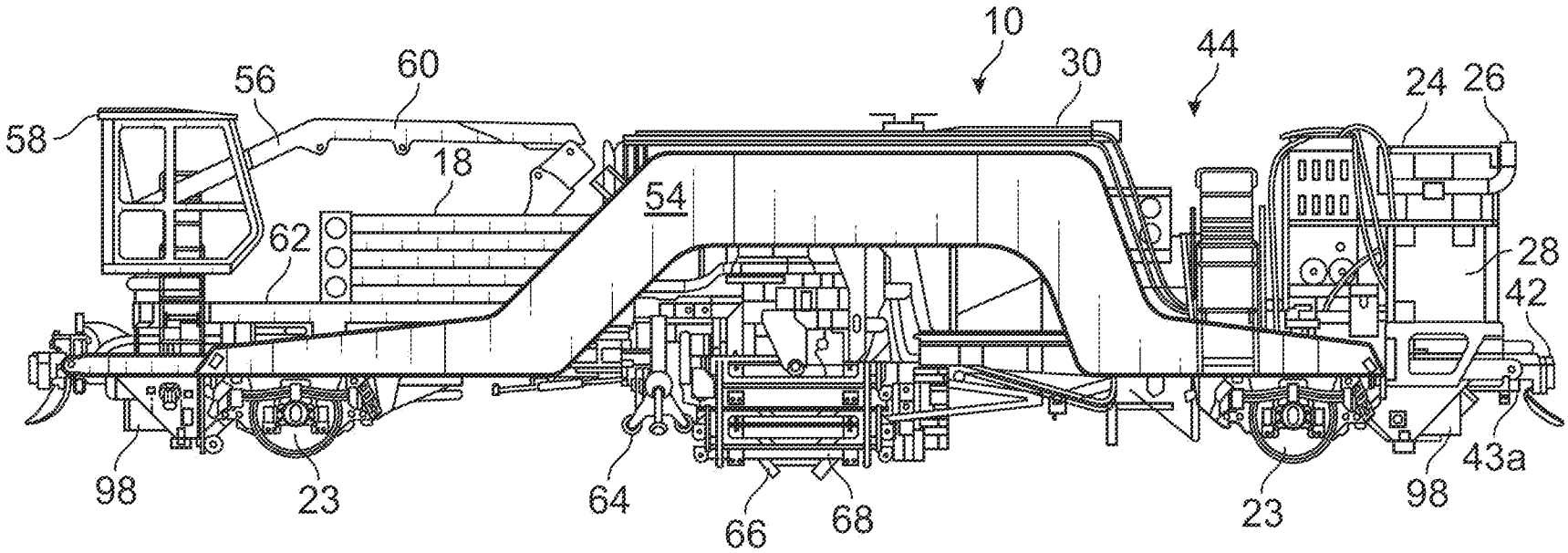
FIG. 8 is a side view of the exchanger module of FIG. 5.
Figure 9:
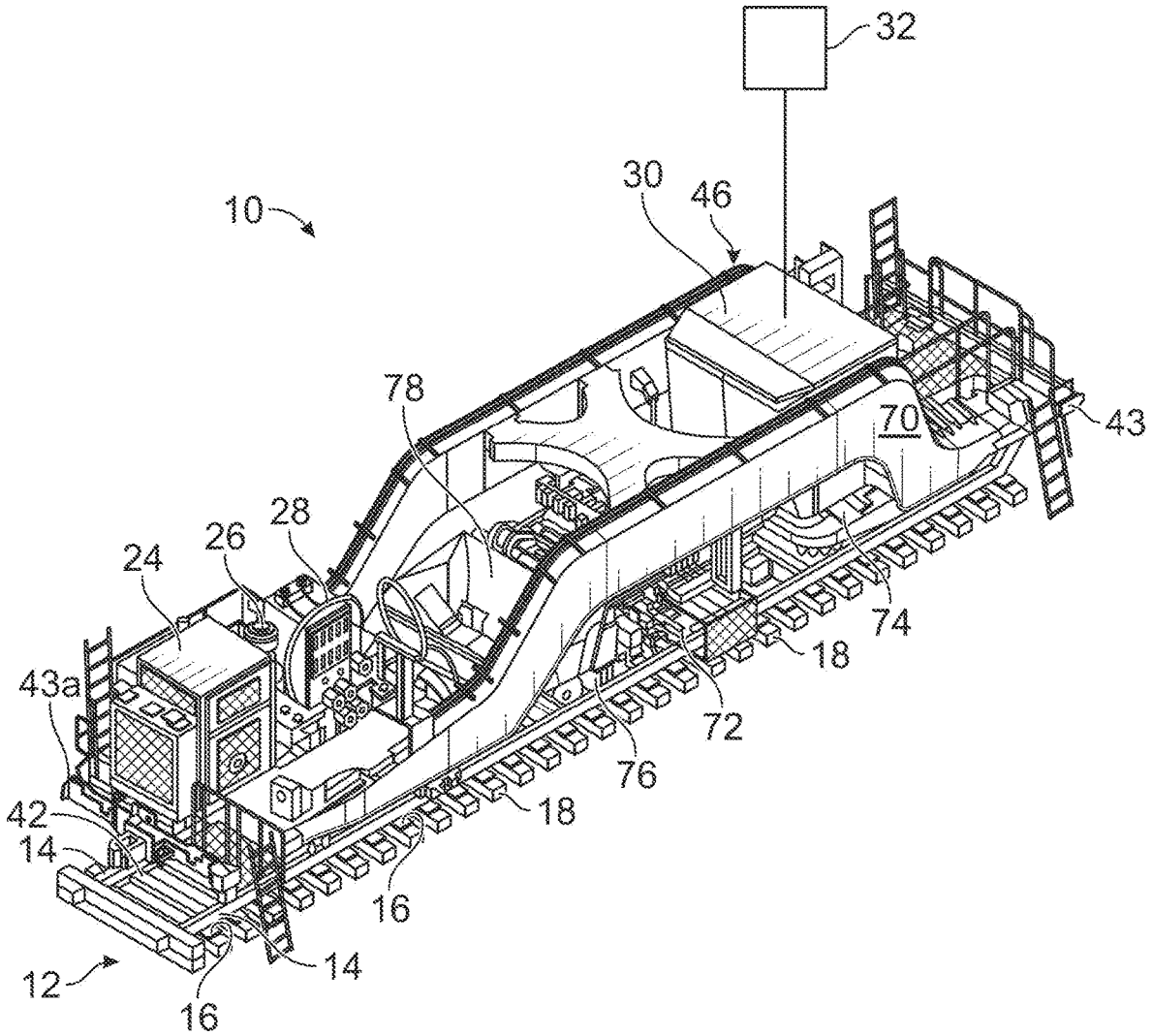
FIG. 9 is a top perspective view of a third, spiker module of a multi-module rail maintenance system according to an embodiment of the invention.
Figure 10:
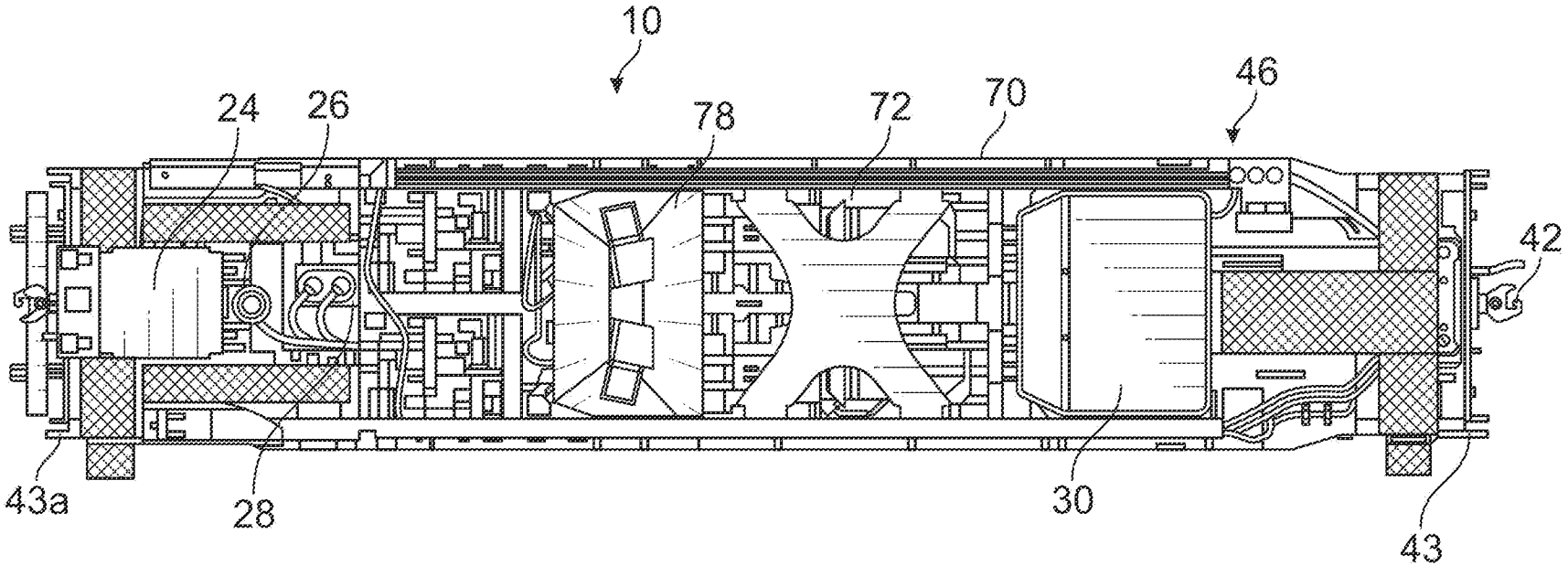
FIG. 10 is a top view of the spiker module of FIG. 9.
Figure 11:
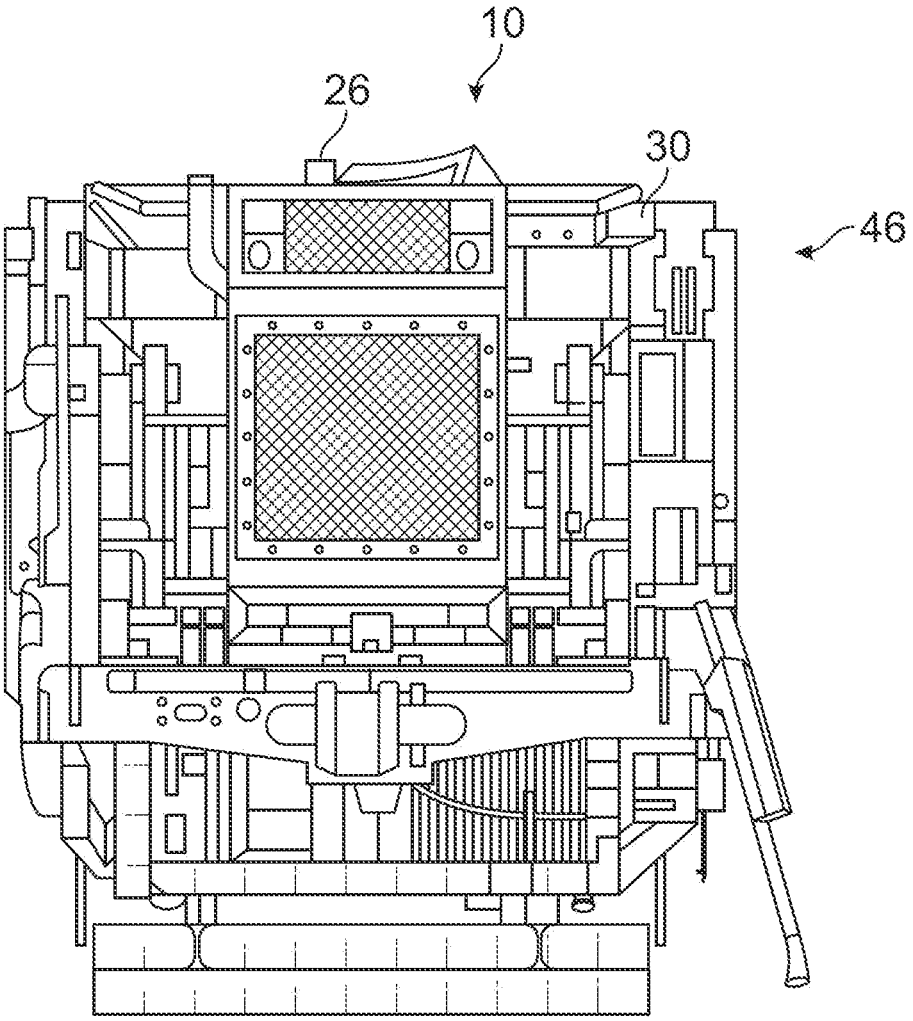
FIG. 11 is a front view of the spiker module of FIG. 9.
Figure 12:
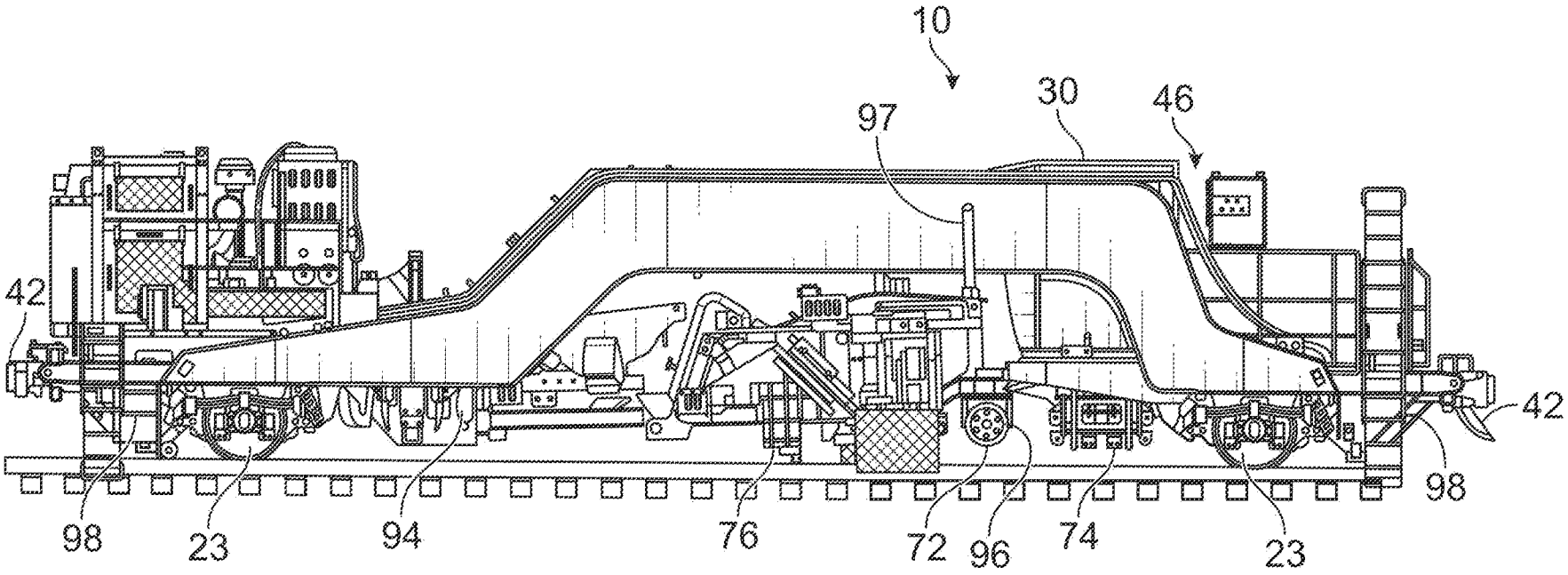
FIG. 12 is a side view of the spiker module of FIG. 9.

Embodiments of the invention relate to railway maintenance equipment. In one embodiment, a rail maintenance of way machine for a route is provided. The machine includes a single chassis supporting a plurality of working modules, the modules include at least a broom module, a spike supply module, a tie spiker module, a spike puller module, and an anchor module. The broom module may manipulate ballast and loose material that are disposed on a location of the route adjacent to the chassis. The spike supply module may provide a fastener. The tie spiker module may receive the fastener from the spike supply module and may drive the supplied fastener through an aperture defined by a tie plate and into a replacement tie. The anchor module may remove an installed anchor from an installed tie and to install an anchor onto the replacement tie.

Additionally, the plurality of working modules may further includes one or more of the optional modules selected from a spike puller, a spike reclaimer, a tie plate reclaimer, a tie bed scarifier, a tie replacer, and a tie tamper. The spike puller module may remove an installed fastener from the installed tie. The spike reclaimer module may retrieve the removed fastener and to supply the removed fastener to the spike supply module. The tie plate reclaimer module may selectively retrieve a tie plate and to install a tie plate onto the replacement tie. The tie bed scarifier module may widen a channel in the ballast. The channel may be a result of the removal of the installed tie. The tie replacement module may retrieve the installed tie from ballast and may place a replacement tie into the ballast at determined intervals and orientations. The tie tamper module may tamp and level a replacement tie. In various embodiments, the number of modules may differ and be selected based in part by application specific requirements and parameters. In one embodiment, there are two or more of the optional modules.

During operation, a controller may cause both the tie spiker module and the anchor squeeze modules to operate on four or more tie spikes and/or four or more anchors, respectively. This action may be done serially or may be done as a batch such that the actions are being performed about simultaneously. Regarding the anchor squeeze module, during operation it may place an anchor on a tie, so that the tie spiker can fasten the anchor to a tie using a spike.

The chassis may be part of a vehicle or vehicle system. There may be a propulsion system coupled to the chassis that may move the machine along a track formed from rails that are fastened to ties with anchors and spikes. The pacing of the vehicle movement may be based in part on the speed at which the slowest of the working modules may complete their task. During operation, the vehicle may index forward (as opposed to steady, slow movement). The amount of distance indexed, and the frequency of movement may be based on a working speed of the modules. In one embodiment, the controller notes completion of the module tasks before allowing (or initiating) movement of the vehicle. In another embodiment, the controller performs a safety check that must be cleared prior the vehicle movement being allowed. The controller may operate, control, and coordinate all the working modules; and the machine may include a plurality of sensors that can provide informational feedback to the controller regarding a status of implements of the working modules and a status of components of the route. The controller may employ machine learning in the operation, control, or coordination of at least one working module In one embodiment, there may be a selectively configurable module having one or more attachment points that can receive an implement, the implement being a remotely controllable work device. A suitable implement may be removably couplable to the at least one attachment point. Suitable implements may be, for example, one or more of an excavating scoop, a grasper claw, a saw, a tamper, a sweeper, a spike driver, a plate retriever, a welder, a sensor package, an electro-magnet, a grinder, and a blower.

A method relating to activities performed on a route is provided. The method includes controlling plural working modules that are arranged on a single chassis to each perform at least one action. Suitable actions may include manipulating ballast and loose material that are disposed on a location of the route adjacent to the chassis; removing an installed anchor from an installed tie and to install an anchor onto the replacement tie; providing a fastener to a spiker module; and receiving the fastener and driving the supplied fastener through an aperture defined by a tie plate and into a replacement tie.

In another embodiment, the act of controlling may include further one or more actions selected from: removing an installed fastener from the installed tie; retrieving the removed fastener; retrieving selectively a tie plate and to install a tie plate onto the replacement tie; widening a channel in the ballast that was a result of the removal of the installed tie; retrieving the installed tie from ballast and placing a replacement tie into the widened channel in the ballast; and tamping and leveling a replacement tie. The controlling may include squeezing or securing one or more anchors. Although scarifying a tie bed may be a selected activity, in one embodiment the method may be performed without scarifying a tie bed. The controlling may include employing machine learning to modify subsequent actions of at least one of the working modules. Machine learning aspects are discussed in more detail herein.

During use, the controller may initiate, control, coordinate, and direct one or more actions selected from supplying compressed air to air-driven tools; bolting together rail segments to form the track; ditching to remove soil from a ditch adjacent to the route; excavating ballast from the route; cleaning ballast that is disposed as part of the route; cross trenching for the deployment of cables and pipes; cribbing and undercutting mainline mud spots; grinding a surface of a rail to achieve a determined profile; storing data relating to geographic coordinates of components used and operations conducted by the controller; and inspecting one or more of the rail, the fastener, the tie, and the ballast. The cleaning of ballast may include removing one or more of ice, mud, water, sand, and soil from ballast material.

Inventive aspects may include a system having a controller and a single chassis. The controller may operate and coordinate plural working modules; and the single chassis may support all the plural working modules. Suitable working modules may include a broom module that may manipulate ballast and loose material that are disposed on a location of the route adjacent to the chassis; a spike supply module that may provide a fastener; a tie spiker module that may receive the fastener from the spike supply module and to drive the supplied fastener through an aperture defined by a tie plate and into a replacement tie; an anchor module that may remove an installed anchor from an installed tie and to install an anchor onto the replacement tie; a spike puller module that may remove an installed fastener from the installed tie; a spike reclaimer module that may retrieve the removed fastener and to supply the removed fastener to the spike supply module; a tie plate reclaimer module that may selectively retrieve the tie plate and to install a tie plate onto the replacement tie; a tie bed scarifier module that may widen a channel left in the ballast as a result of the removal of the installed tie; a tie replacement module that may retrieve the installed tie from ballast and to place a replacement tie into the ballast at determined intervals and orientations; and a tie tamper module that may tamp and level a replacement tie. In one embodiment, the system may have at least four of the modules on the signal chassis.

As each of the modules requires a certain amount of space on the chassis, and the chassis size is constrained in many ways, the ability to mount more modules becomes more challenging. Making modules smaller may lead to less robust and resilient components (for intended use in a very harsh environment). Accordingly, the arrangement and ability for each module to perform its task without running into another module that is performing another task has been addressed, at least in part, by the arrangement of the implement each module uses as well as the use of the controller to coordinate movement not only relative to the working targets (such as the rail or the ballast) but also each of the other implements. Similarly, for example, a spike puller module that pulls a single spike may be designed to be more space efficient and robust than a multi-spike puller. While a multi-spike puller may be more efficient from an overall operational perspective. And, naturally, different module types may require different amounts of space on the chassis. There are tradeoffs, then, in the number and types and functional capacity of the modules, mostly affected by the space constraints but also affected by factors such as cost, serviceability, coordination, safety, and the logical progression of steps in the maintenance processes (for example, you cannot secure a spike in a tie without first obtaining both the spike and the tie). Additional considerations may include the direction and speed of travel of the vehicle, parameters associated with the route, the weather, and the like. The speed of travel, for example, may be limited by the slowest of the modules, which may be determined by the controller.

Referring now to FIGS. 1-4, 9 and 13, a diagram illustrates a multi-function rail maintenance system 10 according to an embodiment of the invention. The system may be constructed and arranged for performing a sequence of rail maintenance operations on a track 12 (FIG. 9) made up of parallel rails 14 resting on tie plates 16 placed on transverse rail ties 18. The rails and the tie plates are held respectively to the rail tie plates and the ties using rail fasteners, typically cut spikes, screws or the like (not shown). Rail anchors may be secured to the rails near the ties to maintain track alignment. The use of coordinated, function-specific, modules or work cars, a complete rail maintenance operation, may be accomplished by a single maintenance system.

In one embodiment, a plurality of function-specific modules or sub-cars may move along the track. In some embodiments, they may be self-propelled, and in other embodiments they may be towable by a powered vehicle.

A first module or puller car 20 includes a main frame or chassis 22 that is configured for travelling on the track using rail wheels 23, a power source 24 (such as an engine 26 or an energy provisioning system), and a hydraulic system 28. A suitable power source may be used for propelling the car along the track. If the engine is not used for propulsion, the puller car is towable along the track. At least one operator's cab 30 houses an operator and at least part of a control system 32 (schematic) and may include at least one display monitor 34.

Included on the puller car may be at least one function-specific modules or workheads. In one embodiment, the puller car includes a spike puller 36, a tie broom 38, and an anchor spreader 40. The tie broom includes a powered, rotating brush. The brush may be used to remove stray ballast from the ties prior to performing the maintenance operation.

The puller car may be equipped with a coupling assembly 42 at each of two ends 43, 43*a* of the main frame. Included on the coupling assembly may be a connecting apparatus that may couple the car to adjacent modules, and connectors associated with a winch apparatus, described below for maintaining tension on ropes connecting adjacent modules for suspending conductor cables above the ground.

Figure 13:
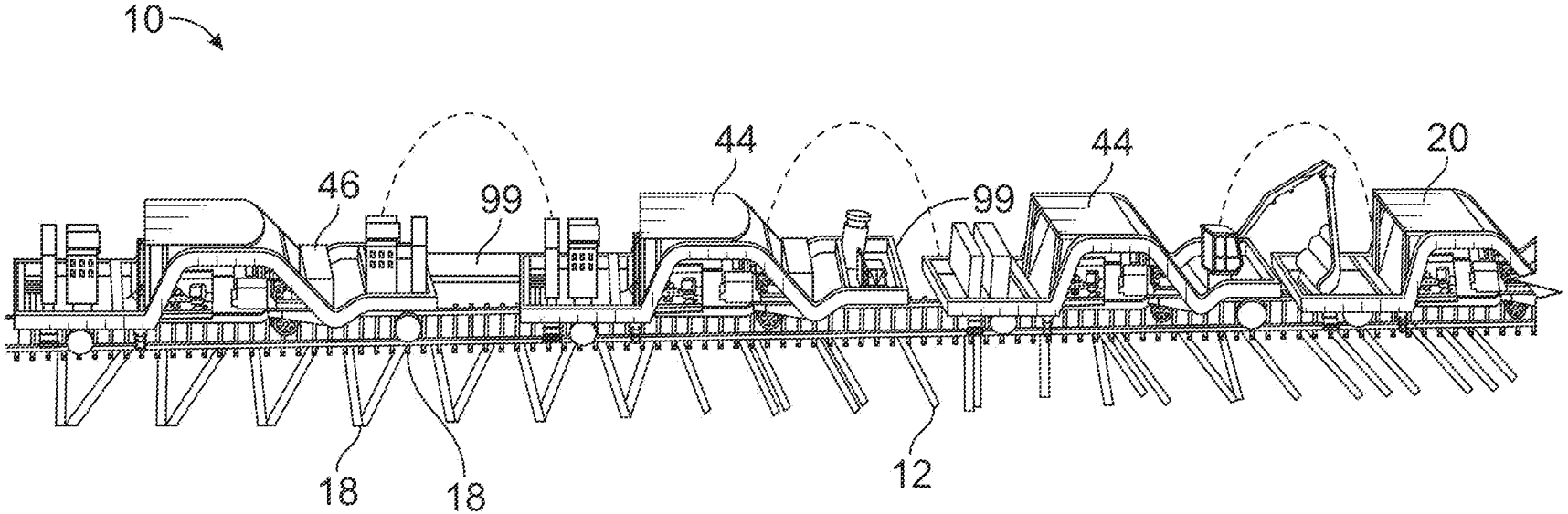
FIG. 13 is a top perspective view of an assembled puller, exchanger, and spiker modules a rail maintenance system according to an embodiment of the invention.

In one embodiment, and referring to FIG. 13, there are at least three modules, the first, puller module, a second, exchanger module 44 and a third, spiker module 46 so that system can perform maintenance operations related to the removal and replacement of a rail tie. In FIG. 13, two exchanger modules are shown. The control system may connect and/or communicate with each module. The controller may initiate, control and coordinate operation of the workheads as well as others described below and may maintain a determined separation distance between the modules, ties, fasteners, and other manipulatable objects.

Referring again to FIGS. 1-4, another feature of the puller module may be an optional discarded material or spike and/or anchor retriever using a magnet 48 (FIG. 4) for collecting withdrawn spikes and anchors and storing them in an on-car collection bin 50. A suitable conveyor 52 moves the collected spikes and anchors to the bin. A spike broom 53 movies pulled spikes out of the way from the rails to a position where they are accessed by the magnet, preferably provided as at least one rotating magnetic drum.

Referring now to FIGS. 5-8, the second module or exchanger module is shown in greater detail. Components shared with the puller module are designated with like reference numbers. As may be the case with the puller module, the exchanger module includes a chassis or main frame 54, a power source (such as an engine, battery bank, fuel cell, etc.), and hydraulic system. An operator cab and/or a housing for the control system may be disposed thereon. As far as function specific workheads, the exchanger module may include a tie handler 56 which may be an operator-controlled crane with a designated cab 58 and a boom 60 used for moving rail ties to and from tie storage areas along the track (FIG. 13), or in some cases to and from a storage area 62. In addition, the exchanger module may include a rail lifter 64 and a tie exchanger 66. The rail lifter may be used for lifting the rail in the area where the tie is to be extracted.

Before the rail is lifted, a tie plate handler 68 grips the tie plate and holds it against the rail. Once the rail and the tie plate are lifted, the tie exchanger grabs an end of the target tie to be replaced, pulls it normally relative to the rails, and places the old tie on the field side of the track. The tie handler may position new ties within a desired target area in relation to an extraction point where the old tie is removed from the track by the tie exchanger. As seen in FIG. 13, new ties may be laid out along the track prior to the maintenance operation. The objective is to place the new ties dose to the place where they will be inserted into the track but leaving room for the extraction of the old tie by the tie exchanger.

A plate handler may be another workhead located on the exchanger module. The plate handler grabs the tie plate from the tie to be extracted, and in this case holds the tie plate to the rail that has been raised by the rail lifter. The exchanger module may be equipped with the coupling assembly described above in relation to the puller module.

Referring now to FIGS. 9-12, the third module or spiker module is disclosed in detail. Features shared among embodiments may be designated with identical reference numbers. As is the case with other modules, the spiker module has a main frame or chassis 70. Main functions of the spiker module are spike driving and anchor squeezing, which are accomplished respectively by a spiker or spike driving workhead 72, and an anchor squeezing workhead 74. An optional workhead may be a tamper apparatus 76.

The ballast tamper apparatus may move the rock ballast so that the newly inserted rail tie may be adequately supported and that the track may be level at that point. Another feature of the third, spiker module may be a bulk spike storage bin 78. The bin may be used to store and deliver spikes to the spiker workhead. Other optional workheads provided to the spiker module include a rail tie nipper and a gauger.

For all the workheads described above for each of the modules, the workheads, especially the spike puller, the tie broom, the anchor spreader, the tie exchanger, the spike driver, the anchor squeezer, and the tamper apparatus may include at least one independently movable workhead frame that may be movable between a retracted or travel position, and a lowered or working position in operational relation to the track.

Figure 14:
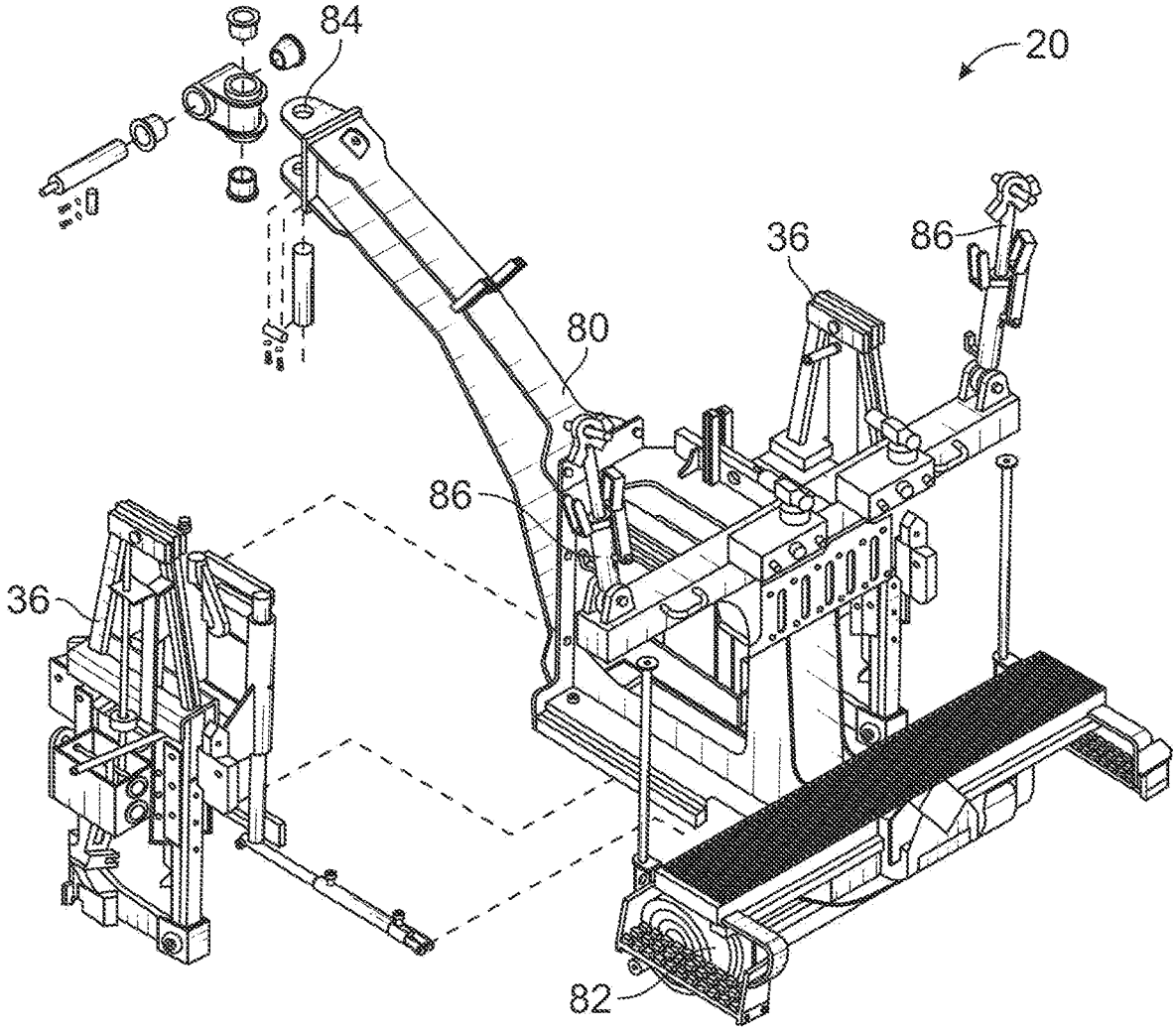
FIG. 14 is a top perspective view of a workhead subframe used with the puller module of FIGS. 1-4.
Figure 15:
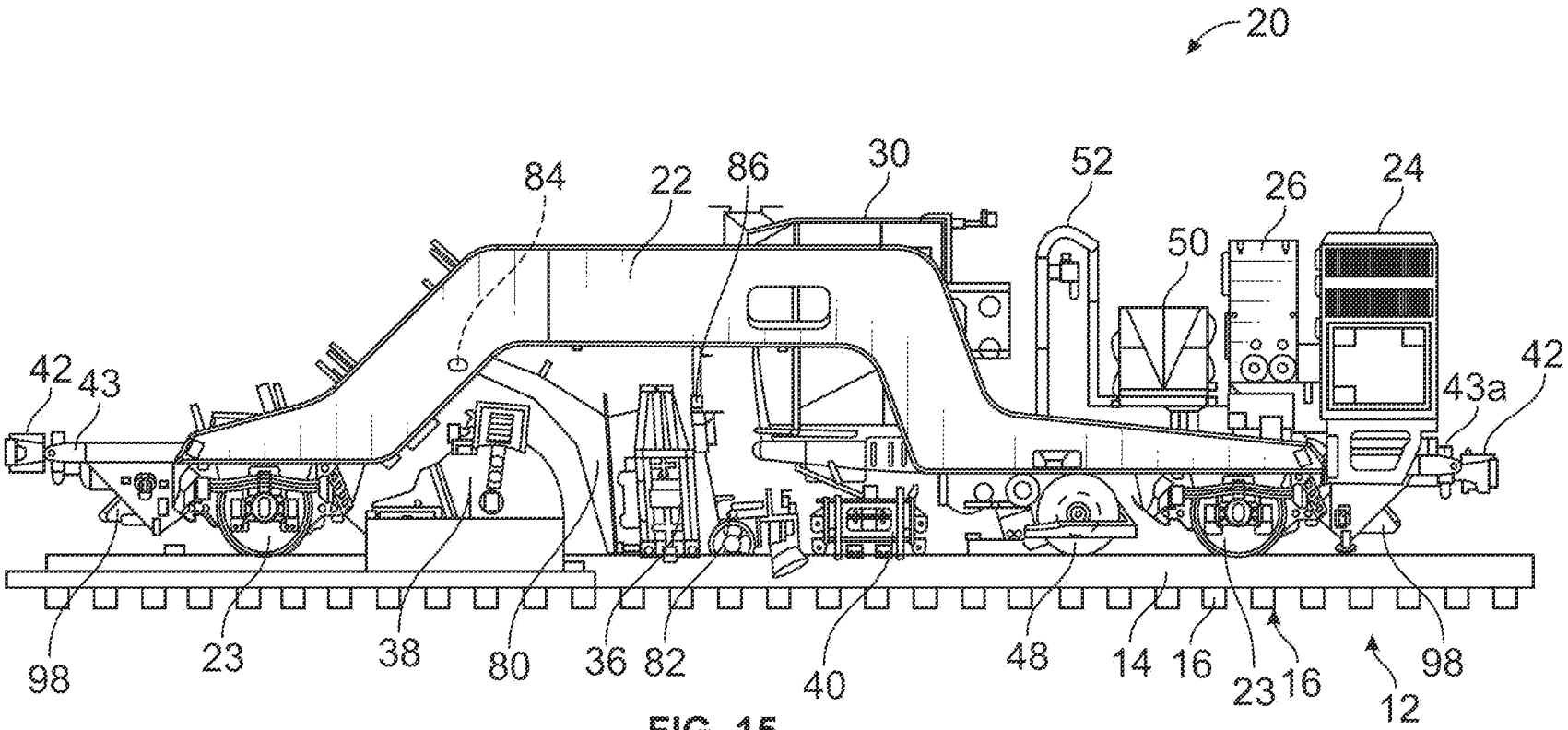
FIG. 15 is a side view of the puller car of FIGS. 1-4 showing the workhead subframe of FIG. 14 in a working position.
Figure 16:
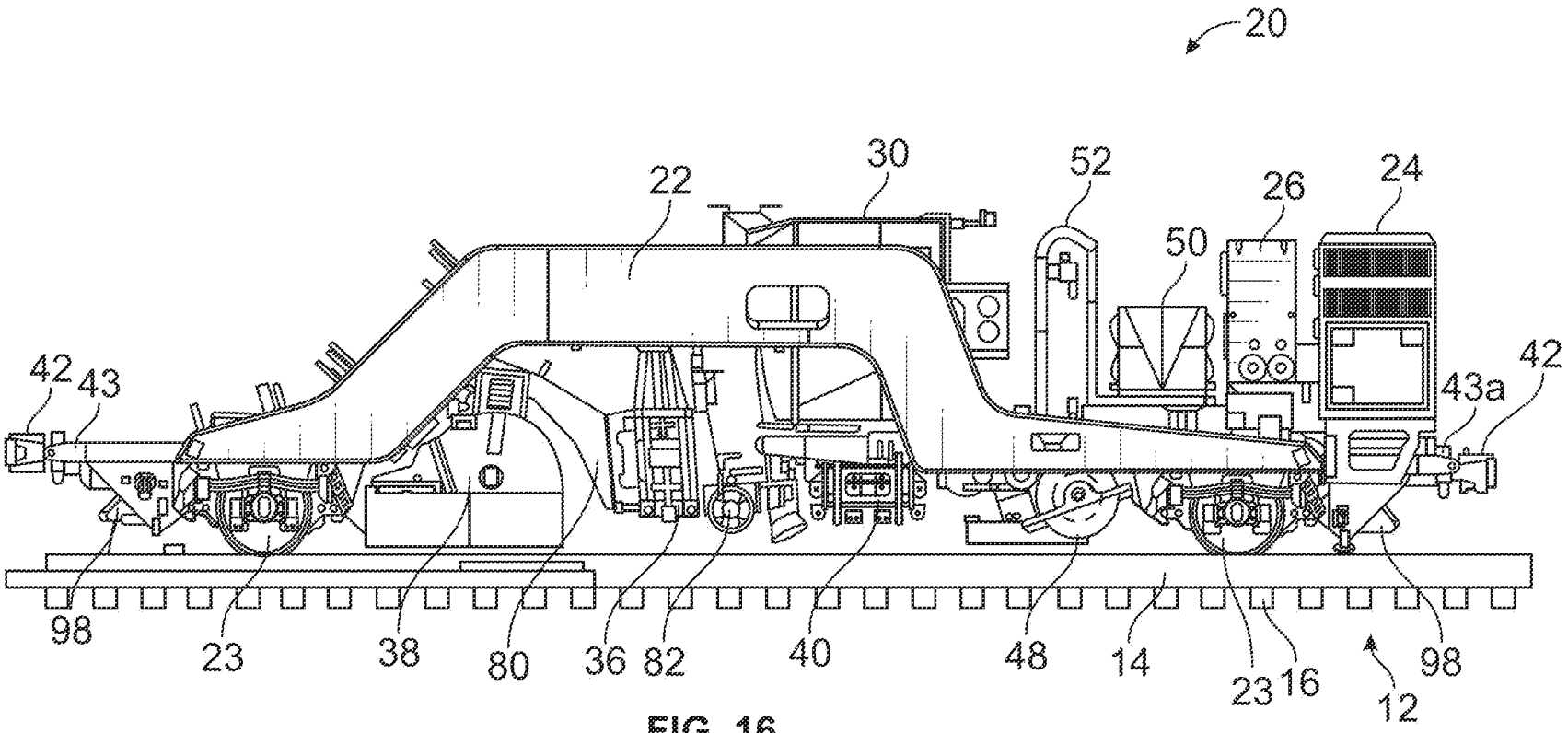
FIG. 16 is a side view of the puller car of FIGS. 1-4 showing the workhead subframe of FIG. 14 in a travel position.
Figure 17:
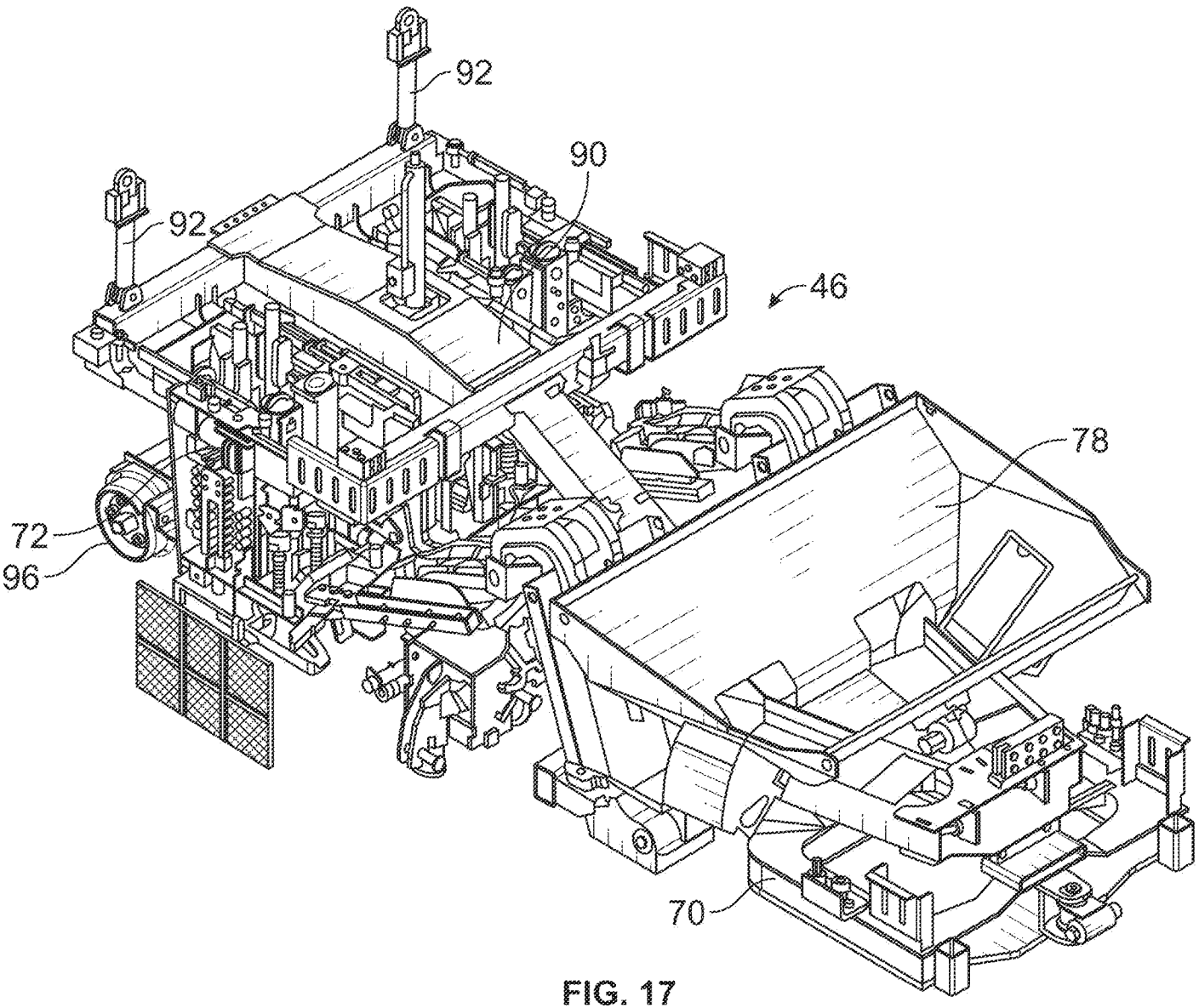
FIG. 17 is a top perspective view of a workhead subframe used with the spiker car of FIGS. 9-12.

Referring now to FIGS. 4 and 14-16, in one embodiment of the puller module, the spike puller may be mounted on a workhead subframe 80 that may be movable relative to the main frame between an operational position (FIGS. 4 and 15) where the subframe may contact the rails, and a retracted or travel position (FIG. 16), which lifts the subframe away from the track for travel purposes when the system moves between worksites. The subframe may have at least one pair of rail wheels 82 which guide the subframe along the track in the lowered position and may pivotally connect to the main frame at a pivot point 84. As seen in FIG. 14, the pivot point may be multi-directional. At least one fluid powered pneumatic or hydraulic cylinder 86 under the control of the control system raises and lowers the subframe between the work position and the travel position. As seen in FIG. 16, in addition to the spike puller, the anchor spreader, the tie magnet and the tie broom are all elevated to a retracted or travel position, using designated hydraulic cylinders (not shown) under the control of the control system.

Figure 18:
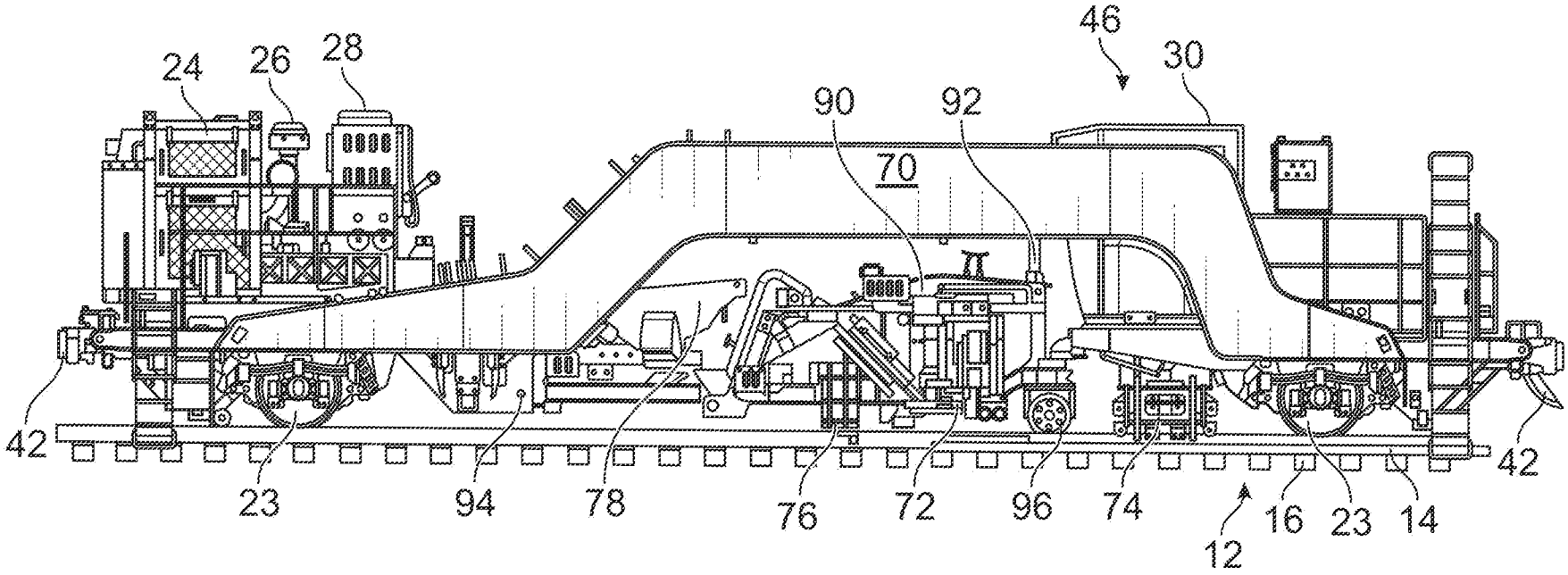
FIG. 18 is a side view of the spiker car of FIGS. 9-12 showing the workhead subframe of FIG. 17 in a working position.
Figure 19:
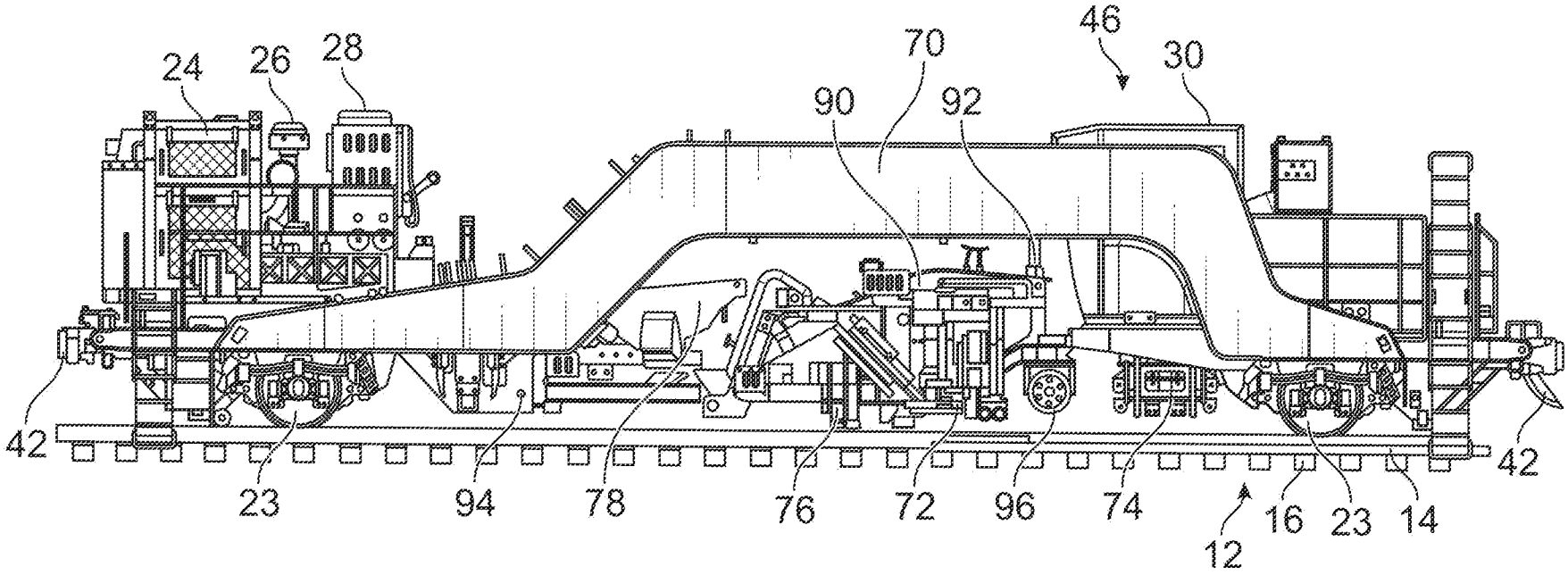
FIG. 19 is a side view of the spiker car of FIGS. 9-12 showing the workhead subframe of FIG. 17 in a travel position.

Referring now to FIGS. 12 and 17-19, in another embodiment, the spiker module may have a movable workhead subframe 90. The spiker workhead may mount to the subframe, and in ay be selectively movable between a retracted, travel position (FIG. 19) and a lowered, working position (FIG. 18) like the subframe discussed above. In the case of this subframe, a pair of fluid power/hydraulic cylinders 92 under control of the control system raise and lower the subframe, which pivots relative to the main frame at a pivot point (FIG. 18). In the lowered, working position, the subframe rides on the rails using guide wheels 96 (FIG. 18). Similar subframes are contemplated for the exchanger module. As seen in FIG. 19, the anchor squeezer may be raised to a travel position by associated actuating cylinders (not shown).

Another feature of the control system may be that the coupling assembly may be adjustable so that when uncoupled, the modules may be independently movable relative to each other in a working condition, and when coupled, are fixed relative to each other in a travel condition. The coupling action may be controlled by hydraulic cylinders that control coupler locking pins. Still another feature of the control system may be that the control system can track the status of a targeted tie, including recording location, maintenance steps performed, and any steps still outstanding, and displaying said tracked status for view by an operator. Further, the control system may be constructed and arranged for measuring the distance between the modules, and from the system to the next tie requiring a maintenance operation to be performed by the system overall, as well as by the particular modules. Once the operator initiates movement of the system, the control system automatically stops at the next optimal location.

Each of the modules may be equipped with a winch apparatus 98. The winch apparatus, in one embodiment, may be hydraulically powered and may be connected to a chain, wire or rope. A winch apparatus may be mounted on one end, or one for each end of the modules. A rope, strap or chain may provide a physical barrier for the places between the modules during work to deter pedestrians from entering this area. At each separation between modules, one of the harriers may have an embedded a multi-conductor cable 99 (FIG. 13). The cable may provide a physical connection between modules for discrete electrical and digital communication between the respective controls systems.

A location and navigation system may be associated with the control system will be used to monitor each workheads position, the distance the modules are telescoped relative to each other, and the position of ties in process, to decide where to next move the system. The control system may connect and/or communicate with various sensors. Suitable sensors may include magnetic, optical, electrical, ultrasonic, navigational, and the like to coordinate the operation of the various workheads on each of the modules, as well as the movement of the units themselves to place the workhead in operational relationship to the targeted tie. Optionally, the user may sequentially perform maintenance tasks on a single tie. In this situation, the system, and/or individual modules may be movable forward and backward on the track to perform the required tasks.

In one embodiment, the various modules can each be performing their respective tasks on targeted ties, some of which may have been already worked on by the other workheads. In this scenario, the system may progress in a single direction along the track.

In one embodiment, the controllers or systems described herein may have a data collection system deployed and may use machine learning to enable derivation-based learning outcomes. The controllers may learn from and make decisions on a set of data (including data provided by the various sensors), by making data-driven predictions and adapting according to the set of data. In embodiments, machine learning may involve performing a plurality of machine learning tasks by machine learning systems, such as supervised learning, unsupervised learning, and reinforcement learning. Supervised learning may include presenting a set of example inputs and desired outputs to the machine learning systems. Unsupervised learning may include the learning algorithm structuring its input by methods such as pattern detection and/or feature learning. Reinforcement learning may include the machine learning systems performing in a dynamic environment and then providing feedback about correct and incorrect decisions. In examples, machine learning may include a plurality of other tasks based on an output of the machine learning system. In examples, the tasks may be machine learning problems such as classification, regression, clustering, density estimation, dimensionality reduction, anomaly detection, and the like. In examples, machine learning may include a plurality of mathematical and statistical techniques. In examples, the many types of machine learning algorithms may include decision tree based learning, association rule learning, deep learning, artificial neural networks, genetic learning algorithms, inductive logic programming, support vector machines (SVMs), Bayesian network, reinforcement learning, representation learning, rule-based machine learning, sparse dictionary learning, similarity and metric learning, learning classifier systems (LCS), logistic regression, random forest, K-Means, gradient boost, K-nearest neighbors (KNN), a priori algorithms, and the like. In embodiments, certain machine learning algorithms may be used (e.g., for solving both constrained and unconstrained optimization problems that may be based on natural selection). In an example, the algorithm may be used to address problems of mixed integer programming, where some components restricted to being integer-valued. Algorithms and machine learning techniques and systems may be used in computational intelligence systems, computer vision, Natural Language Processing (NLP), recommender systems, reinforcement learning, building graphical models, and the like. In an example, machine learning may be used making determinations, calculations, comparisons, and behavior analytics, and the like.

In one embodiment, the controllers may include a policy engine that may apply one or more policies. These policies may be based at least in part on characteristics of a given item of equipment or environment. With respect to control policies, a neural network can receive input of a number of environmental and task-related parameters. These parameters may include, for example, operational input regarding operating equipment, data from various sensors, location and/or position data, and the like. The neural network can be trained to generate an output based on these inputs, with the output representing an action or sequence of actions that the equipment or system should take to accomplish the goal of the operation. During operation of one embodiment, a determination can occur by processing the inputs through the parameters of the neural network to generate a value at the output node designating that action as the desired action. This action may translate into a signal that causes the vehicle to operate. This may be accomplished via back-propagation, feed forward processes, closed loop feedback, or open loop feedback. Alternatively, rather than using backpropagation, the machine learning system of the controller may use evolution strategies techniques to tune various parameters of the artificial neural network. The controller may use neural network architectures with functions that may not always be solvable using backpropagation, for example functions that are non-convex. In one embodiment, the neural network has a set of parameters representing weights of its node connections. A number of copies of this network are generated and then different adjustments to the parameters are made, and simulations are done. Once the output from the various models is obtained, they may be evaluated on their performance using a determined success metric. The best model is selected, and the vehicle controller executes that plan to achieve the desired input data to mirror the predicted best outcome scenario. Additionally, the success metric may be a combination of the optimized outcomes, which may be weighed relative to each other.

As used herein, the terms "processor" and "computer," and related terms, e.g., "processing device," "computing device," and "control unit" "control system" and "controller" are not limited to just those integrated circuits but further refer to a microcontroller, a microcomputer, a programmable logic controller (PLC), field programmable gate array, and application specific integrated circuit, and other programmable circuits. Suitable memory may include, for example, a computer-readable medium. A computer-readable medium may be, for example, a random-access memory (RAM), a computer-readable non-volatile medium, such as a flash memory. The term "non-transitory computer-readable media" represents a tangible computer-based device implemented for short-term and long-term storage of information, such as, computer-readable instructions, data structures, program modules and sub-modules, or other data in a device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. As such, the term includes tangible, computer-readable media, including, without limitation, non-transitory computer storage devices, including without limitation, volatile and non-volatile media, and removable and non-removable media such as firmware, physical and virtual storage, CD-ROMS, DVDs, and other digital sources, such as a network or the Internet.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify a quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

The subject matter described herein is not limited in its application to the details of construction and the arrangement of components set forth in the description herein or illustrated in the drawings hereof. The subject matter described herein is capable of other embodiments and of being practiced or of being modularized out in various ways. Also, the phraseology and terminology used herein is for the purpose of description and should not be regarded as limiting. The use of "including," "comprising," or "having" and variations thereof herein is meant to encompass the items listed thereafter and equivalents thereof as well as additional items. Further, in the following claims, the phrases "at least A or B" "A and/or B", and "one or more of A or B" (where "A" and "B" represent claim elements), are used to encompass i) A, ii) B and/or iii) both A and B.

This written description uses examples to disclose the embodiments, including the best mode, and to enable a person of ordinary skill in the art to practice the embodiments, including making and using devices or systems and performing incorporated methods. The claims define the patentable scope of the disclosure, and include other examples that occur to those of ordinary skill in the art. Such other examples are within the scope of the claims if they have structural elements that do not differ from the literal language of the claims, or if they include equivalent structural elements with insubstantial differences from the literal language of the claims.

What is claimed is:

1. A rail maintenance of way machine for a route, comprising:

at least one chassis configured to support one or more working modules; and a plurality of working modules comprising:

a broom module configured to manipulate ballast and loose material that are disposed on a location adjacent to the route;

a spike supply module configured to provide a fastener;

a tie spiker module configured to receive the fastener from the spike supply module and to drive the fastener provided by the spike supply module through an aperture defined by a tie plate and into a replacement tie; and an anchor module configured to remove an installed anchor from an installed tie and to install an anchor onto the replacement tie.

2. The machine of claim 1, wherein the tie plate is a first tie plate and the plurality of working modules further comprise one or more modules selected from:

a spike puller module configured to remove an installed fastener from the installed tie;

a spike reclaimer module configured to retrieve the fastener that is removed and to supply the fastener that is removed to the spike supply module;

a tie plate reclaimer module configured to selectively retrieve the first tie plate and to install a second tie plate onto the replacement tie;

a tie bed scarifier module configured to widen a channel left in the ballast because of removal of the installed tie;

a tie replacement module configured to retrieve the installed tie from ballast and to place a replacement tie into the ballast at determined intervals and orientations; and a tie tamper module configured to tamp and level a replacement tie.

3. The machine of claim 1, further comprising:

a controller configured to operate, control, and coordinate all the working modules; and a plurality of sensors configured to provide informational feedback to the controller regarding a status of implements of the working modules and a status of components of the route.

4. The machine of claim 1, further comprising:

a controller configured to employ machine learning in operation, control, or coordination of at least one working module.

5. The machine of claim 1, further comprising:

a controller configured to prevent movement of the chassis and of the working modules until receiving a signal that determined work areas are clear of obstructions.

6. The machine of claim 1, further comprising a propulsion system coupled to the chassis that is configured to move the machine along a track at a speed determined by a controller.

7. The machine of claim 1, wherein the anchor squeeze module is configured to place an anchor on a tie, so that the tie spiker module can fasten the anchor to a tie using a spike.

8. The machine of claim 1, further comprising a selectively configurable module having one or more attachment points that are configured to receive an implement, the implement being a remotely controllable work device.

9. The machine of claim 8, further comprising the implement removably coupled to the one or more attachment points.

10. The machine of claim 8, wherein the implement is one of an excavating scoop, a grasper claw, a saw, a tamper, a sweeper, a spike driver, a plate retriever, a welder, a sensor package, an electro-magnet, a grinder, and a blower.

11. The machine of claim 1, wherein both the tie spiker module and the anchor squeeze modules are configured to simultaneously operate on four or more tie spikes and/or four or more anchors, respectively.

12. A method of rail maintenance of way for a route, comprising:

controlling plural working modules supported by a chassis to each perform, in coordination with each other, at least one action selected from:

manipulating ballast and loose material that are disposed on a location of the route adjacent to the chassis;

removing an installed anchor from an installed tie and to install an anchor onto a replacement tie;

providing a fastener to a spiker module; and receiving the fastener and driving the fastener through an aperture defined by a tie plate and into a replacement tie.

13. The method of claim 12, wherein the tie plate is a first tie plate, and controlling further comprises one or more actions selected from:

removing an installed fastener from the installed tie;

retrieving the fastener that is removed;

retrieving selectively the first tie plate and to install a second tie plate onto the replacement tie;

widening a channel in the ballast that was a result of the removal of the installed tie;

retrieving the installed tie from ballast and placing a replacement tie into the channel in the ballast that is widened; and tamping and leveling a replacement tie.

14. The method of claim 12, further comprising squeezing or securing one or more anchors.

15. The method of claim 12, wherein the method is performed without scarifying a tie bed.

16. The method of claim 12, wherein controlling comprises employing machine learning to modify subsequent actions of at least one of the working modules.

17. The method of claim 12, further comprising controlling the plural working modules supported by the chassis to each perform, in coordination with each other, one or more actions selected from:

supplying compressed air to air-driven tools;

bolting together rail segments to form the route;

ditching to remove soil from a ditch adjacent to the route;

excavating ballast from the route;

cleaning ballast that is disposed as part of the route;

cross trenching for deployment of cables and pipes;

cribbing and undercutting mainline mud spots;

grinding a surface of a rail to achieve a determined profile;

storing data relating to geographic coordinates of components used and operations conducted by the controller; and inspecting one or more of the rail, the fastener, the tie, and the ballast.

18. The method of claim 12, further comprising controlling the plural working modules supported by the chassis to each perform, in coordination with each other, cleaning ballast that is disposed as part of the route, wherein cleaning ballast comprises removing one or more of ice, mud, water, sand, and soil from ballast material.

19. A system, comprising:

a controller configured to operate and coordinate plural working modules; and one or more chassis supporting all the plural working modules, wherein the plural working modules comprise at least four of:

a broom module configured to manipulate ballast and loose material that are disposed on a location of a route adjacent to the chassis;

a spike supply module configured to provide a fastener;

a tie spiker module configured to receive the fastener from the spike supply module and to drive the fastener provided by the spike supply module through an aperture defined by a first tie plate and into a replacement tie;

an anchor squeeze module configured to remove an installed anchor from an installed tie and to install an anchor onto the replacement tie;

a spike puller module configured to remove an installed fastener from the installed tie;

a spike reclaimer module configured to retrieve the fastener that is removed and to supply the fastener that is removed to the spike supply module;

a tie plate reclaimer module configured to selectively retrieve the first tie plate and to install a second tie plate onto the replacement tie;

a tie bed scarifier module configured to widen a channel left in the ballast because of removal of the installed tie;

a tie replacement module configured to retrieve the installed tie from ballast and to place a replacement tie into the ballast at determined intervals and orientations; and a tie tamper module configured to tamp and level a replacement tie.

20. The system of claim 19, wherein the plural working modules further comprise a tie spiker module configured to receive a fastener from a spike supply module and to drive the fastener provided by the spike supply module through an aperture defined by a first tie plate and into a replacement tie and an anchor squeeze module configured to remove an installed anchor from an installed tie and to install an anchor onto the replacement tie, wherein the controller is configured to control the tie spiker module and the anchor squeeze module to simultaneously operate on four or more tie spikes and/or four or more anchors, respectively.

* * * * *